US005748563A

United States Patent [19]

Hofmann

[11] Patent Number: 5,748,563

[45] Date of Patent: May 5, 1998

[54] ENERGY CONVERTER FOR GENERATING HIGH-POWER PULSES

[75] Inventor: Jurgen Hofmann, Salzwedel, Germany

[73] Assignee: TZN Forschungs- und Entwicklungszentrum Unterlüss GmbH, Unterlüss, Germany

[21] Appl. No.: 703,872

[22] Filed: Aug. 27, 1996

[30] Foreign Application Priority Data

Sep. 1, 1995 [DE] Germany ..... 195 32 219.3

[51] Int. Cl.[6] ..... H04R 23/00

[52] U.S. Cl. ..... 367/147; 601/4

[58] Field of Search ..... 367/147; 601/4; 128/66.01, 662.03

[56] References Cited

U.S. PATENT DOCUMENTS

| | | | |
|---|---|---|---|
| 2,559,227 | 7/1951 | Rieber | 128/24 |
| 3,416,128 | 12/1968 | Allen | 367/147 |
| 3,575,631 | 4/1971 | Pratt | 313/232 |
| 4,693,247 | 9/1987 | Brisson et al. | 128/328 |
| 4,715,376 | 12/1987 | Nowacki et al. | 367/147 |
| 4,821,729 | 4/1989 | Makofski et al. | 601/4 |
| 4,905,674 | 3/1990 | Nowacki et al. | 601/4 |
| 5,220,913 | 6/1993 | Horbal et al. | 601/4 |
| 5,240,002 | 8/1993 | Brisson et al. | 367/147 |
| 5,251,614 | 10/1993 | Cathignol et al. | 601/4 |
| 5,458,652 | 10/1995 | Uebelacker | 367/147 |

FOREIGN PATENT DOCUMENTS

| | | |
|---|---|---|
| 2 605 874 | 5/1988 | France . |
| 497 205 | 5/1930 | Germany . |
| 90/11051 | 10/1990 | WIPO . |
| 91/19459 | 12/1991 | WIPO . |

OTHER PUBLICATIONS

Lee et al, "Acoustical Imaging", vol. 18, pp. 501–510.

*Primary Examiner*—J. Woodrow Eldred
*Attorney, Agent, or Firm*—Spencer & Frank

[57] ABSTRACT

An energy converter for generating high-power pulses includes a housing defining a chamber having an open side; an electrode assembly supported in the chamber; a power supply for applying a voltage to the electrode assembly; a fluid medium accommodated in the housing and being in contact with the electrode assembly for receiving pulses from the electrode assembly; and a diaphragm attached to the housing and closing the open side of the housing for encapsulating the electrode assembly and the fluid medium in the chamber. The diaphragm has an inner surface oriented toward the chamber and is in contact with the fluid medium. The diaphragm further has an outer surface oriented away from the chamber and is arranged for contacting a substance to be comminuted, whereby mechanical pulses transmitted from the fluid medium to the diaphragm are applied by the diaphragm to the substance to be comminuted.

6 Claims, 4 Drawing Sheets

ENERGY CONVERTER FOR GENERATING HIGH-POWER PULSES

CROSS REFERENCE TO RELATED APPLICATION

This application claims the priority of German Application No. 195 32 219.3 filed Sep. 1, 1995, which is incorporated herein by reference.

BACKGROUND OF THE INVENTION

This invention relates to an energy converter for generating high-power pulses. Such devices are known in a wide variety of constructions.

Thus, German Patent No. 3,506,583 describes an energy converter for destroying kidney stones. The electrode system which generates the high-power pulses is disposed in the same liquid-filled vessel as the substance to be comminuted. It is a drawback of such an arrangement that because of the interaction between the comminuted material and the electrode system, a substantial fluctuation of the energy conversion occurs.

Further disadvantages of known systems reside in that the materials may be comminuted only in a wet state and the soiling of the working medium (liquid) results in fluctuations during energy conversion. Because of the fact that the converter is integrated in the working medium (such as water) only a single preferred plane is obtained.

SUMMARY OF THE INVENTION

It is an object of the invention to provide an improved energy converter of the above-outlined type which makes possible a dry comminution of substances.

This object and others to become apparent as the specification progresses, are accomplished by the invention, according to which, briefly stated, the energy converter for generating high-power pulses includes a housing defining a chamber having an open side; an electrode assembly supported in the chamber; a power supply for applying a voltage to the electrode assembly; a fluid medium accommodated in the housing and being in contact with the electrode assembly for receiving pulses from the electrode assembly; and a diaphragm attached to the housing and closing the open side of the housing for encapsulating the electrode assembly and the fluid medium in the chamber. The diaphragm has an inner surface oriented toward the chamber and is in contact with the fluid medium. The diaphragm further has an outer surface oriented away from the chamber and is arranged for contacting a substance to be comminuted, whereby mechanical pulses transmitted from the fluid medium to the diaphragm are applied by the diaphragm to the substance to be comminuted.

In addition to the dry comminution or re-forming of the material to be treated, the encapsulated energy converter according to the invention has the advantage of a diversified use. The energy converter according to the invention may be readily integrated into the converter system without substantial alterations thereto. The drying stage for the material to be comminuted or re-formed is dispensed with as are rotary components of the treating zone.

According to an advantageous feature of the invention, the diaphragm is made of a flexible material, resulting in very low energy losses during the energy conversion into pressure pulses. For this reason the energy converter itself has a lower energy consumption.

According to a further advantageous feature of the invention, the inner face of the housing wall defining the chamber has an elliptical shape which also contributes to a low energy consumption. By concentrating the pressure waves at the diaphragm by virtue of the elliptical shape, a reduction of the total energy conversion related to the material to be comminuted is achieved.

The invention may find application in general where pressure pulses are to be applied directly to a material, for example, for recycling.

DESCRIPTION OF THE PREFERRED EMBODIMENT

Figure 1:
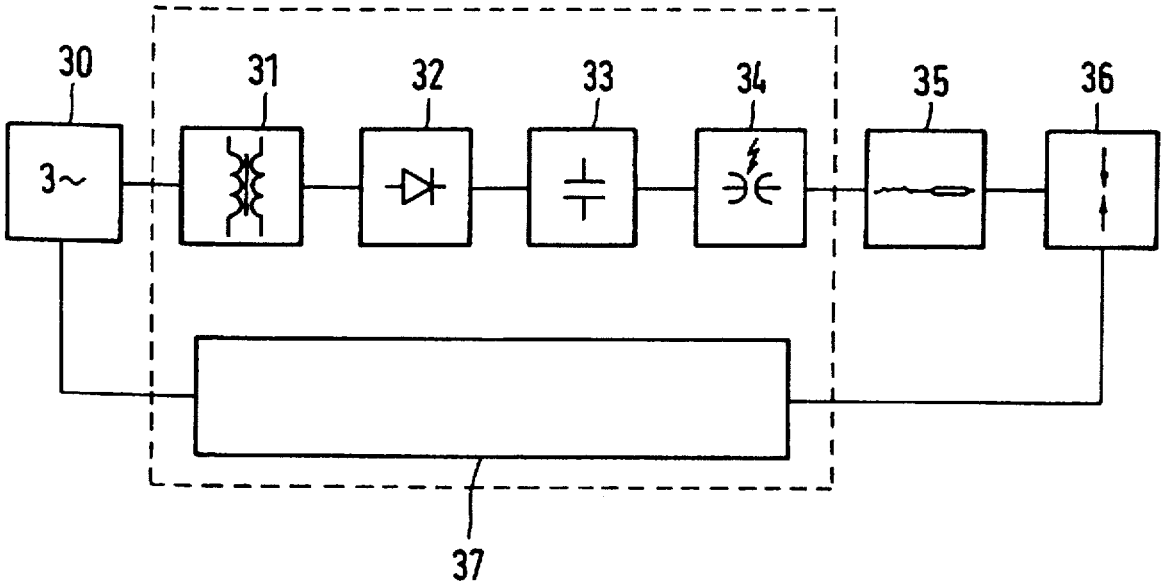
FIG. 1 is a block diagram of an energy supplying system for generating high-power pulses.

Turning to FIG. 1, energy for generating electrical high-power pulses is supplied for storage in a condenser 33 from a net voltage source 30 through a charging current limiter 31 and a high-voltage rectifier 32.

The stored energy is applied by a high-power switch 34 via an energy conducting system 35 to an energy converter 36. The feedback for regulating the energy supply is effected by a control-and-safety unit 37.

Figure 3:
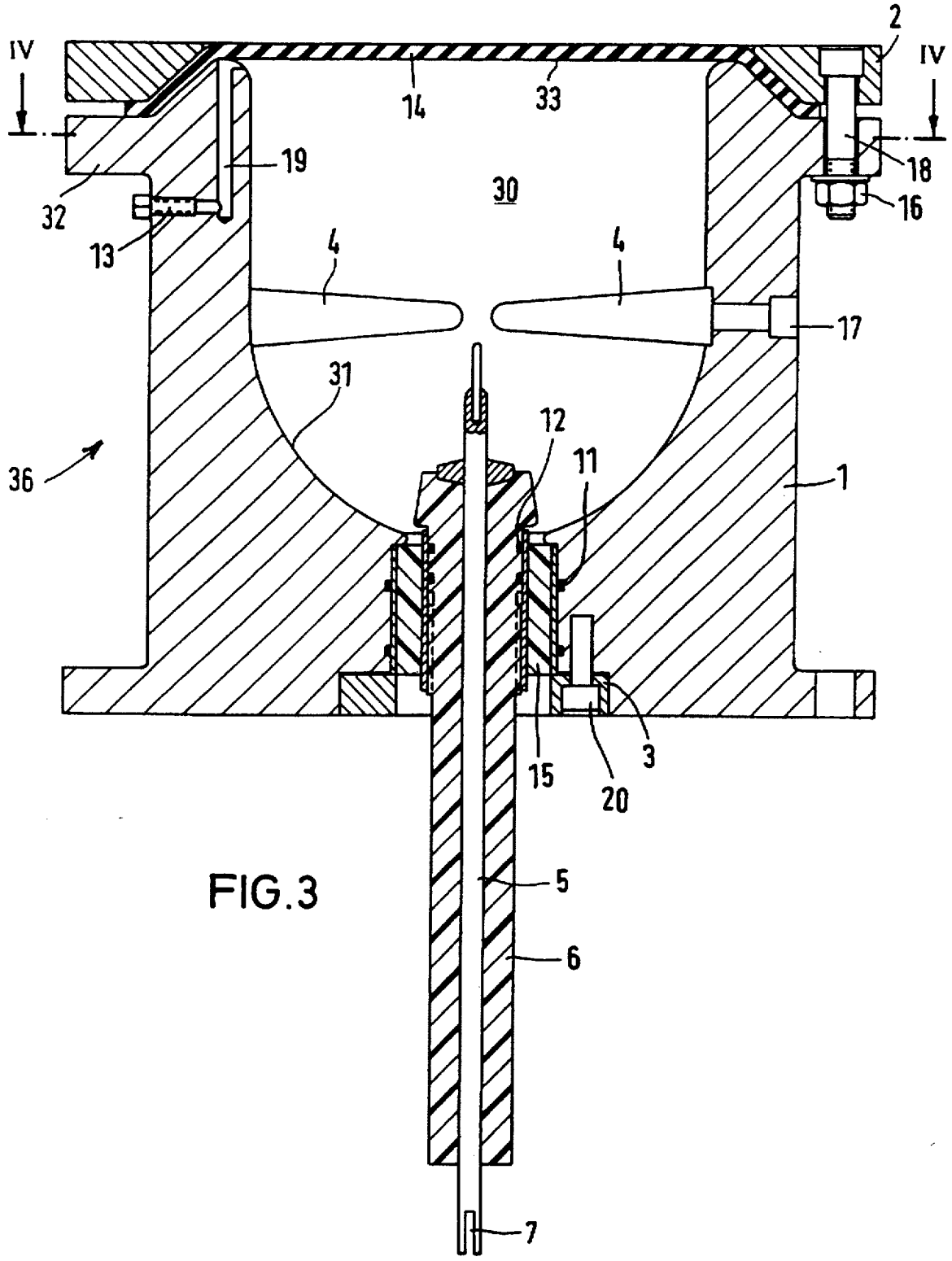
FIG. 3 is a sectional side elevational view of an energy converter according to a preferred embodiment of the invention.

Turning to FIG. 3, the energy converter 36 includes a housing 1 having an inner housing wall 41 defining a chamber 40. The housing 1 has an open side 43. The inner shape of the housing 1 is elliptical.

An anode electrode 5 passes through an insulator sleeve 6 supported in the housing 1 and projects into the chamber 40. The anode electrode 5 extends outwardly from the insulator sleeve 6 and constitutes a terminal 7 for a high-voltage cable. The insulator sleeve 6 is secured in a bore of the housing 1 by a modified Megi-HL sleeve 15 with the interposition of O-ring seals 11 and 12 and by virtue of a supporting ring 3 and allen screws 20 threadedly received in the housing 1. Further, three grounded electrodes 4 extend into the chamber 40 and are oriented perpendicularly to the anode electrode 5. The electrodes 4 are secured to the housing 1 by allen screws 17 with the interposition of a seal washer 10. The grounded electrodes 4 are situated in a single plane and are offset preferably 120° without contacting one another.

According to the invention, the open side 43 of the housing 1 is hermetically closed by a diaphragm 14 clamped to the housing 1 by a ring 2 which is tightened to a collar (flange) 42 of the housing 1 by means of screws 18 and nuts 16. The housing 1 is provided with at least one vent bore 19 closed by a screw 13 by means of which the inner pressure in the housing chamber 40 may be controlled.

Figure 4:
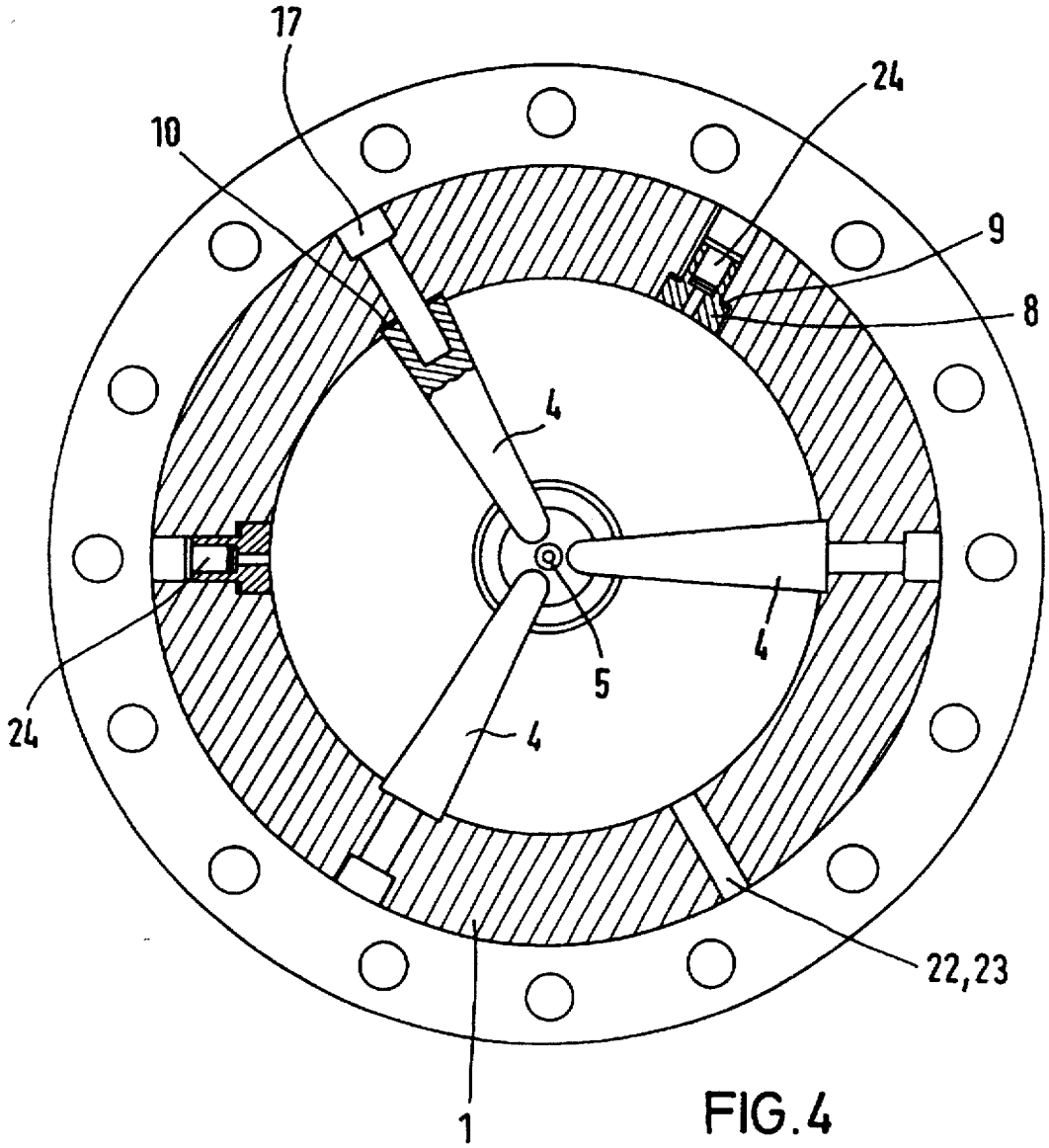
FIG. 4 is a sectional view taken along line IV—IV of FIG. 3.

The introduction of the work fluid, such as water, into and its withdrawal from the chamber 40 is effected by at least one, but preferably two fluid supply devices 22 and 23 shown in FIG. 4. The water supply devices 22, 23 may be adapted to requirements; as the simplest variant, spherical valves are provided which regulate the water inlet and water outlet.

Pressure sensors 24 may be secured to the housing 1 with the aid of adapters 8 to be exposed to the pressure in the chamber 40. The pressure sensors 24 which are situated immediately adjacent the diaphragm 14 supply data on the internal pressure conditions to a process monitor for protecting the diaphragm 14 from destruction.

Figure 2:
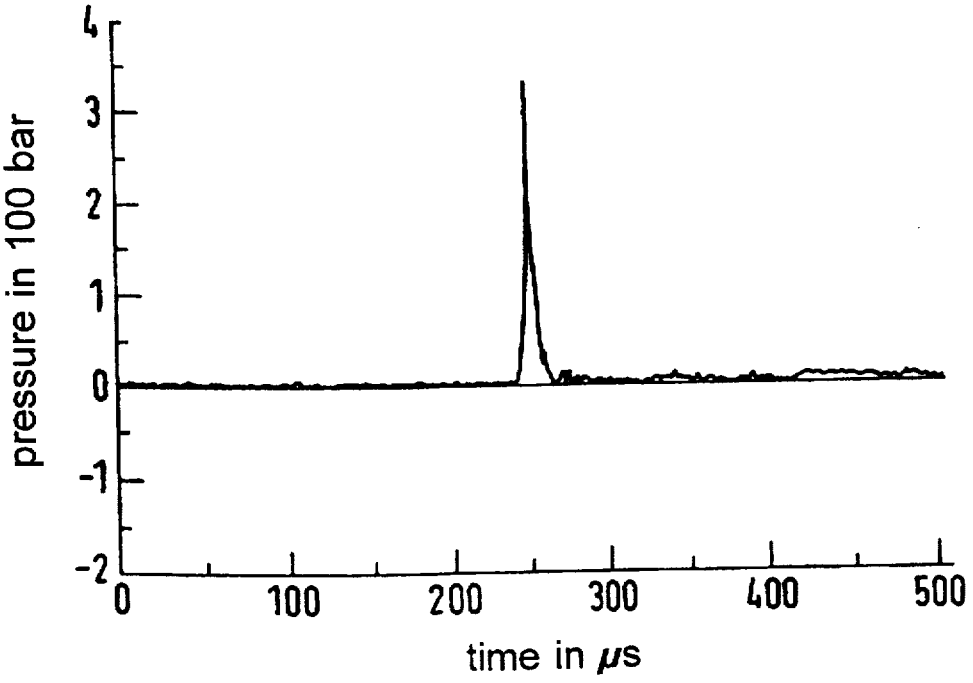
FIG. 2 is a diagram illustrating the pressure applied to a material as a function of time.

Referring once again to FIGS. 1 and 3, during operation a plasma channel is formed in the liquid work medium between the anode electrode 5 and the grounded electrodes 4. The energy of the condenser 33 is applied in the μs range to the plasma channel. This results in a densification of a layer in the work medium. The layer expands spherically and functions as an energy carrier. The course of the pressure applied to the material to be treated (comminuted or re-shaped) by the diaphragm 14 of the energy converter 36 is shown in FIG. 2.

In the course of the developing phase of the electric discharge a rapid expansion of the plasma channel occurs. At the shell of the plasma channel a pressure density change is obtained which propagates in the work medium as a high-power pulse. In this manner, dependent upon the design of the discharging circuit, a high-power pulse of a μs duration generates a peak pressure up to 1000 bar. The working range principally lies between 200–600 bar. The high-power pulses are energy carriers, that is, they constitute the tool.

By means of the diaphragm 14, a series of high-power pulses are introduced into the substance to be treated. The peak pressure, that is, the maximum pressure of the first pulse and the slope of the pressure increase are of decisive significance concerning the energy conversion. It is noted that the steeper the slope the higher the pressure.

The pressure pulse generated in the above-described manner causes a pressure and tension stress, a removal of connecting boundaries at grain boundaries as well as a destruction or re-forming of the material at the unstable locations of the substance to be treated.

It will be understood that the above description of the present invention is susceptible to various modifications, changes and adaptations, and the same are intended to be comprehended within the meaning and range of equivalents of the appended claims.

What is claimed is:

1. An energy converter for generating a high-power pulse for comminuting or deforming a substance, comprising (a) a housing defining a single chamber having an elliptical inner wall and an open side;

(b) an electrode assembly formed of a plurality of electrodes supported in said chamber and arranged to allow an electric discharge therebetween;

(c) power supply means for applying a voltage to said electrode assembly for effecting an electric discharge between said electrodes to generate a high-power pulse of a μs duration with a peak pressure in a range between 200 and 1000 bar;

(d) a fluid medium accommodated in said housing and being in contact with said electrode assembly for receiving said high-power pulse from said electrode assembly; and (e) a diaphragm attached to said housing and closing said open side for encapsulating said electrode assembly and said fluid medium in said chamber; said diaphragm having an inner surface oriented toward said chamber and being in contact with said fluid medium; said diaphragm having an outer surface oriented away from said chamber and being arranged for contacting a substance to be comminuted, whereby the high-power pulse transmitted from said fluid medium to said diaphragm is applied by said diaphragm directly to the substance in contact with said diaphragm.

2. The energy converter as defined in claim 1, wherein said electrode assembly comprises an anode electrode insulated from said housing and a grounded electrode being perpendicular to and coplanar with said anode electrode.

3. The energy converter as defined in claim 1, wherein said fluid medium is water.

4. The energy converter as defined in claim 3, further comprising means for introducing water into and for withdrawing water from said chamber.

5. The energy converter as defined in claim 1, further comprising a pressure sensor supported in said housing and exposed to pressures in said chamber.

6. The energy converter as defined in claim 1, further comprising clamping means for tightening said diaphragm to said housing; said clamping means including a clamping ring.

* * * * *